US007032764B2

(12) United States Patent
Viggiano

(10) Patent No.: US 7,032,764 B2
(45) Date of Patent: Apr. 25, 2006

(54) INFANT CARE APPARATUS

(76) Inventor: Gregory R. Viggiano, 610 N. West St., No. 408, Alexandria, VA (US) 22314

( * ) Notice: Subject to any disclaimer, the term of this patent is extended or adjusted under 35 U.S.C. 154(b) by 0 days.

(21) Appl. No.: 10/866,726

(22) Filed: Jun. 15, 2004

(65) Prior Publication Data

US 2004/0210253 A1 Oct. 21, 2004

Related U.S. Application Data

(60) Provisional application No. 60/551,923, filed on Mar. 10, 2004.

(51) Int. Cl.
*A61J 9/00* (2006.01)

(52) U.S. Cl. ..... 215/11.4; 215/11.1; 606/234; 606/236

(58) Field of Classification Search ..... 215/11.1–11.6; 606/234–236; 222/71, 380, 387, 402.1, 402.23, 222/490, 544–564
See application file for complete search history.

(56) References Cited

U.S. PATENT DOCUMENTS

| | | | | |
|---|---|---|---|---|
| 2,584,359 | A | 2/1952 | Miles | |
| 3,126,116 | A * | 3/1964 | Clinehens | 215/11.1 |
| 4,301,934 | A | 11/1981 | Forestal | |
| 4,620,638 | A | 11/1986 | Schmidt | |
| 4,640,424 | A | 2/1987 | White | |
| 4,856,995 | A * | 8/1989 | Wagner | 433/215 |
| 4,898,291 | A * | 2/1990 | Sailors | 215/11.4 |
| 4,969,564 | A * | 11/1990 | Cohen et al. | 215/11.1 |
| 5,145,094 | A * | 9/1992 | Perlmutter | 222/153.14 |
| 5,295,597 | A * | 3/1994 | Green | 215/11.4 |
| 5,680,965 | A * | 10/1997 | Beck | 222/153.06 |
| 5,749,483 | A * | 5/1998 | Tebeau | 215/11.4 |
| 5,791,503 | A * | 8/1998 | Lyons | 215/11.5 |
| 6,197,044 | B1 | 3/2001 | Clayton | |
| 6,257,429 | B1 | 7/2001 | Kong | |
| 2004/0188372 | A1 * | 9/2004 | Ruth et al. | 215/11.4 |

* cited by examiner

*Primary Examiner*—Glenn K. Dawson
(74) *Attorney, Agent, or Firm*—Shoemaker and Mattare

(57) ABSTRACT

An infant care apparatus including a nipple having a nipple passage for drawing fluid therethrough. A fitting is adapted to secure the infant care apparatus on a closure adapted to regulate flow between the infant care apparatus and a container. A valve is adapted to regulate flow between the nipple passage and the closure.

18 Claims, 4 Drawing Sheets

INFANT CARE APPARATUS

REFERENCE TO EARLIER APPLICATION

This Application claims the benefit of U.S. Provisional Application No. 60/551,923, filed Mar. 10, 2004, by Gregory R. Viggiano, entitled Combined Pacifier/Nipple with Quick Connect Fitting for Bottle.

BACKGROUND OF THE INVENTION

A popular way to feed infants is with nursing bottles. A nursing bottle typically includes an elongate container containing fluid sustenance that is connected to a resilient nipple having a passage and an opening through which the infant may draw the sustenance. The opening is biased into a normally closed position, restricting fluid from exiting the bottle. When an infant sucks on the nipple, the negative pressure created urges fluid from the container into and through the passage, out of the opening, then into the infant's mouth. Numerous containers and nipples for infant bottle feeding exist.

During or after feeding, many infants pacify themselves by sucking or gumming on objects, such as a nursing bottle nipple or conventional pacifier. These pacifying activities may stimulate development and/or aid in falling asleep. Numerous infant pacifiers also exist.

Infants often alternate between feeding and pacifying activities, especially toward the end of a feeding when an infant may be falling asleep. When an infant is falling asleep, parents are reluctant to agitate the infant by removing what the infant may be sucking or gumming on, such as a nursing bottle nipple. However, permitting the infant to suck on a conventional nipple, rather than a designated pacifier, allows the infant to draw air through the passage in the nipple, which the infant would swallow eventually in an uncomfortable amount. Ingested air can cause infants to become uncomfortable and colicky.

Infants' requirement for nourishment and predilection for pacifying activities, and the disparate requirements and limitations on devices for same, illuminate a need for a combined pacifier/nipple that allows an infant to draw fluid therethrough when feeding, yet prohibits the infant from drawing fluid therethrough when pacifying.

In addition to having appropriate infant care equipment, infant care givers need to be able to use or manipulate the equipment, typically while simultaneously holding onto an infant at the same time. Feeding, changing bottles or pacifying the infant while holding an infant and tending to accessories typically on hand, like diaper bags, can be cumbersome and frustrating. Thus, a need exists for combining the function of the bottle nipple and the pacifier to free care givers for managing other matters while holding an infant.

Sometimes care givers provide infants with fluid readily available from commercial establishments, like bottled water. Commercial packaging for such fluids often have a resealable, pushable closure or valved cap assembly. Unfortunately, infants often are not skilled enough to drink from such closures without spilling. Thus, a need exists for a combined pacifier/nipple with a quick connect fitting that is mountable on a valved cap assembly.

What is needed and not taught or suggested in the art is a simple, combined pacifier/nipple with a quick connect fitting.

SUMMARY OF THE INVENTION

The invention is a simple, combined pacifier/nipple with quick connect fitting for mounting on containers with valved cap assemblies. The invention includes an integrally-formed nipple/pacifier and base configured to mount on a container closure, and a valve. The valve may be opened, to allow an infant to draw fluid through the nipple, and closed, to allow the infant to use the combined pacifier/nipple as a pacifier without ingesting gas.

The invention provides a combined pacifier/nipple with a quick connect fitting which simplifies pacifying and feeding children in the delivery of water, milk, formula, breast milk or other appropriate beverage with secure, detachable, and interchangeable parts. The invention allows greater convenience with respect to: saving time, simplicity of use, ease of assembly/disassembly, faster bottle changes, less spillage, easier cleaning and lower cost.

An embodiment constructed according to principles of the invention provides an infant care apparatus including a nipple having a nipple passage for drawing fluid therethrough. A fitting is adapted to secure the infant care apparatus on a closure adapted to regulate flow between the infant care apparatus and a container. A valve is adapted to regulate flow between the nipple passage and the closure.

Another embodiment constructed according to principles of the invention provides an infant care apparatus including a closure adapted to regulate flow between the infant care apparatus and a container. A fitting is adapted to secure the infant care apparatus on the closure. The infant care apparatus has a nipple having a nipple passage for drawing fluid therethrough. A valve is adapted to regulate flow between the nipple passage and the closure.

Another embodiment constructed according to principles of the invention provides an infant care apparatus including a container and a closure adapted to regulate flow between the infant care apparatus and the container. A fitting is adapted to secure the infant care apparatus on the closure. The infant care apparatus has a nipple having a nipple passage for drawing fluid therethrough. A valve is adapted to regulate flow between the nipple passage and the closure.

An embodiment constructed according to principles of the invention includes a combined pacifier/nipple assembly removably connectable via a quick connect/disconnect snap-on/snap-off fitting to a typical bottle fitted with an integrated bottle valved cap assembly mounted on the upper end thereof. The integrated bottle valved cap assembly contains a valve in place on the bottle's cap that is operable between an open and closed condition, to allow or prevent the flow of liquid or air from the bottle. The combined pacifier/nipple assembly portion is positioned on the bottle's integrated valved cap assembly and may be installed by centering and pressing thereon to engage the snap-on/snap-off fitting. The combined pacifier/nipple assembly has its own internal anti-leak valve therein which aligns with the bottle's integrated valved cap assembly such that both can valves operate independently of each other and can be placed in an open or closed condition when the combined pacifier/nipple assembly is installed on to the bottle's integrated valved cap assembly. Both valves operate independently of each other such that removal of the combined pacifier/nipple assembly via a quick connect/disconnect snap-on/snap-off fitting from the bottle's integrated valved cap assembly requires the user to manually close one or both valves, such that liquid or air will be prevented from flowing out of the bottle, and such that liquid or air will be prevented from passing through the pacifier into the nipple on the pacifier.

The invention provides numerous advantages. The invention provides quick connect/disconnect interchangeable fittings that allow for easy one-handed bottle changes and other handling. The invention provides a pacifier/bottle nipple combined in one assembly. Combining the bottle nipple and the pacifier reduces the number of parts to carry. The invention provides a combined pacifier/nipple assembly with an inexpensive, simple, internal anti-leak valve. The invention requires no small external removable parts, such as locking rings, that could present a choking hazard to children. The invention can be manufactured inexpensively, thus allowing it to be disposable or reusable. The invention is easy to clean and dishwasher safe. The invention has commercial value because it is convenient, simple to use, easy to assemble/disassemble, faster with bottle changes, less prone to spillage and greatly affordable.

The invention provides a combined pacifier/nipple assembly removably connectable with a typical bottle fitted with an integrated bottle valved cap assembly, and an internal anti-leak valve contained within the combined pacifier/nipple assembly that selectively allows or prevents liquid or air to flow therethrough. In the closed condition, the combined pacifier/nipple assembly is sealed and allows an infant to use the combined pacifier/nipple assembly as a pacifier without ingesting air.

The invention provides a combined pacifier/nipple assembly is safe, inexpensive, simple to understand, easy to clean, and less cumbersome than a separate bottle and pacifier, enabling a care giver to manage an infant and equipment easily with one hand.

The invention provides improved elements and arrangements thereof, for the purposes described, which are inexpensive, dependable and effective in accomplishing intended purposes of the invention.

Other features and advantages of the invention will become apparent from the following description of the preferred embodiments which refers to the accompanying drawings.

BRIEF DESCRIPTION OF THE DRAWINGS

The invention is described in detail below with reference to the following drawings, throughout which similar reference characters denote corresponding features consistently, wherein.

DETAILED DESCRIPTION OF THE PREFERRED EMBODIMENTS

Figure 1:
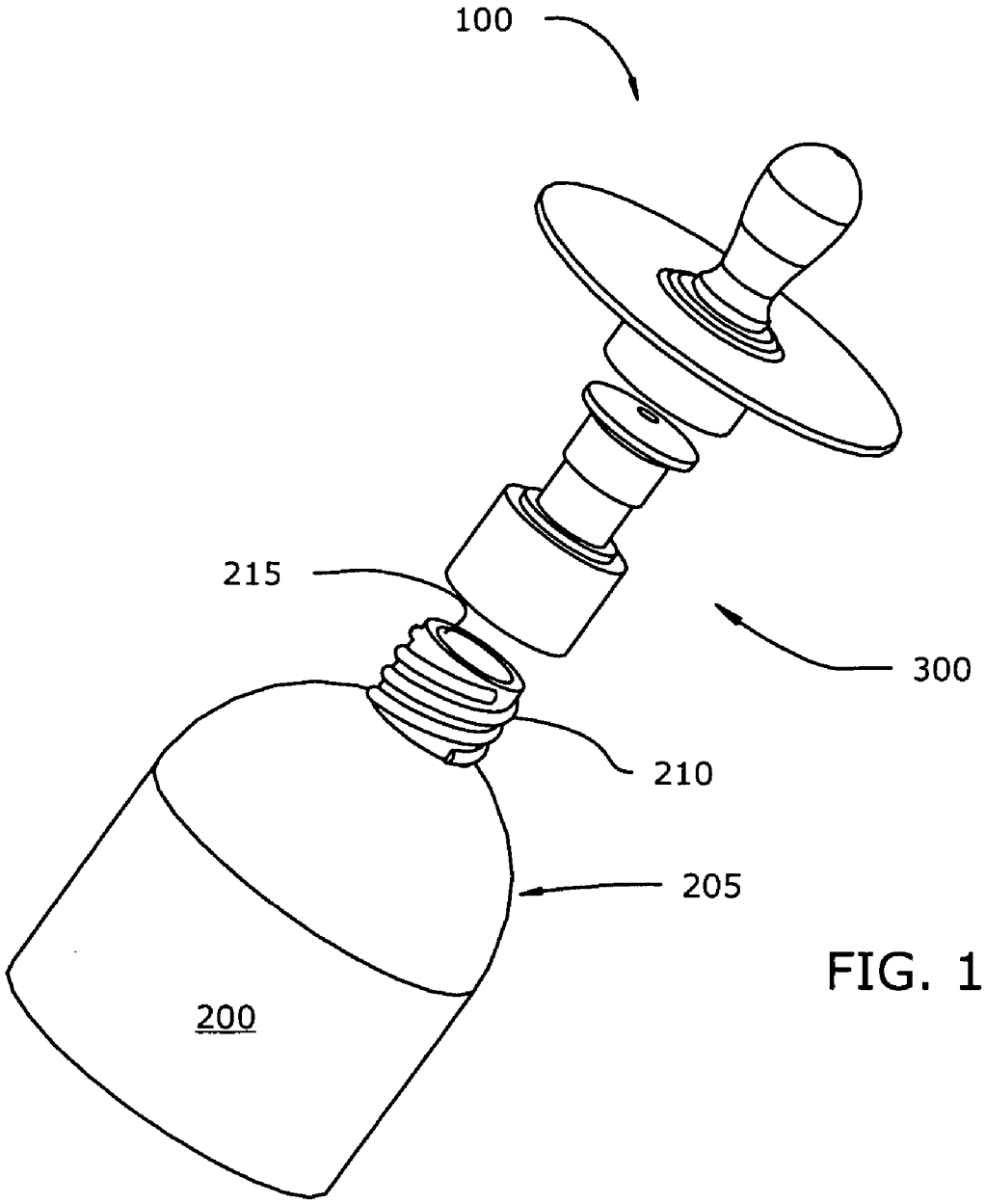
FIG. 1 is an exploded top side elevational view of an embodiment of an infant care apparatus constructed according to principles of the invention, shown with a conventional bottle and valved cap assembly.

Referring to FIG. 1, an embodiment constructed according to principles of invention includes an infant care apparatus 100, here shown with a conventional bottle 200 having a valved cap assembly 300.

Bottle 200 and valved cap assembly 300 preferably are constructed from a hard, unbreakable/shatter-proof plastic material. Bottle 200 has a generally tapered upper end 205 that terminates in an externally threaded neck 210 with an opening 215.

Figure 2:
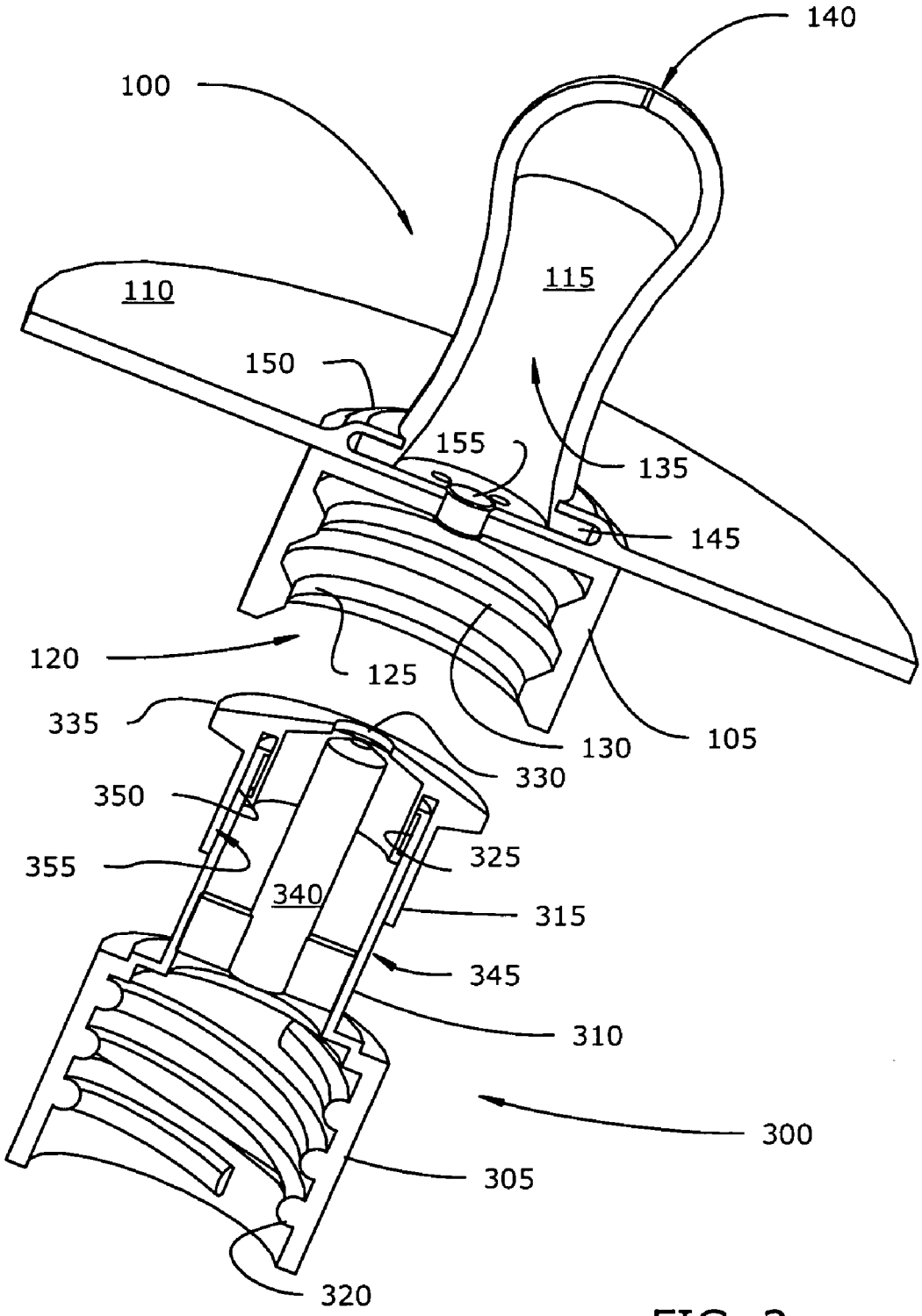
FIG. 2 is a cross-sectional detail view of the infant care apparatus and valved cap assembly of FIG. 1.

Referring to FIG. 2, valved cap assembly 300 includes a base 305, a spout 310 and a top 315. Base 305 has internal threads 320 for threadingly engaging threaded neck 210. Other mounting conventions between base 305 and bottle 200 suitable for purposes described herein may be employed.

Spout 310 extends from, and may be integral with, base 305. Spout 310 defines a passage 325 for voiding fluid (not shown) from bottle 200. Spout 310 is constructed from materials and defines an outer surface 345 that allow top 315 to slide relative to spout 310 while maintaining a fluid seal therewith.

Top 315 defines a passage 350 for receiving spout 310. Top 315 is constructed from materials and defines an inner surface 355 that allow top 315 to slide relative to spout 310 while maintaining a fluid seal therewith. Top 315 has a centrally disposed aperture 330 for selectively providing in fluid communication with passage 350. Top 315 also has a lip 335 to facilitate moving top 315 relative to base 305.

A stopper 340 is disposed in passage 325 for regulating fluid flow. As shown, when top 315 assumes a closed position relative to spout 310, stopper 340 plugs aperture 330 preventing fluid flow. When top 315 is pulled relative to base 305 to assume an open position (not shown), stopper 340 is withdrawn from aperture 330 permitting fluid flow.

Valved cap assembly 300 may have a cover (not shown) to prevent contamination of portions of valved cap assembly 300 received orally or otherwise delivering fluid for consumption.

Infant care apparatus 100 includes a fitting 105, a shield 110 and a nipple 115. Fitting 105 preferably is constructed of a rubber or silicon or similar soft, elastic, resilient, plastic material for installation ease. Fitting 105 is removably connectable to valved cap assembly 300. Fitting 105 defines a lower cavity 120 configured to receive top 315 and lip 335, and frictionally engage and maintain a fluid seal therewith when fully received. Fitting 105 may have radially inwardly extending bulges 125 and 130 for providing an interference fit with top 315 and/or lip 335. Preferably, fitting 105 is configured so that, when mounted on top 315, exerting requisite force on fitting 105 opens or closes valved cap assembly 300. Different types of mounting conventions between fitting 105 and valved cap assembly 300 also may be employed including, but not limited to, snap on/snap off, twist on/twist off, and partial-turn bayonet. However, the invention may employ any mounting and/or sealing convention suitable for the purposes described herein.

Nipple 115 preferably is constructed of rubber, silicon or similar soft, elastic, resilient, plastic material. Nipple 115 defines an upper cavity 135 and has an opening 140 through which fluid may be drawn. Nipple 115 has a flange 145 for retaining nipple 115 relative to infant care apparatus 100.

Shield 110 preferably is configured to prevent ingestion of infant care apparatus 100. Shield 110 has a boss 150 for sealingly retaining flange 145 of nipple 115. Shield 110 is rotatingly connected to fitting 105 with, for example, a rivet 155.

Figure 3:
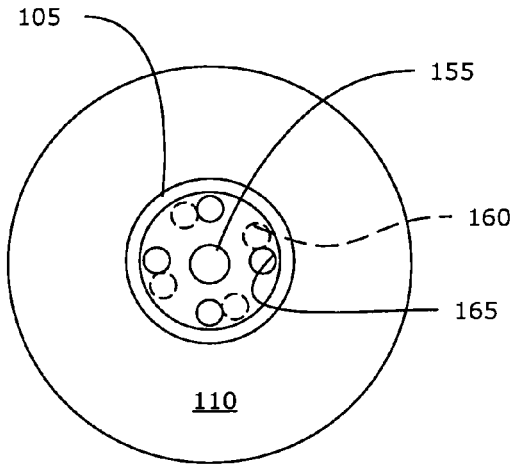
FIG. 3 is a bottom elevational view of the infant care apparatus of FIG. 1.

Referring also to FIG. 3, shield 110 has annularly-diverged throughbores 160. Fitting 105 has complementary annularly-diverged throughbores 165. Shield 110 may be rotated relative to fitting 105 so that throughbores 160 are in registry with throughbores 165, defining an open position for promoting fluid communication. Shield 110 may be rotated relative to fitting 105 so that throughbores 160 are not in registry with throughbores 165, defining a closed position for preventing fluid communication.

In operation, to provide an infant fluid from a bottle 200 having a valved cap assembly 300 via infant care apparatus 100, a care giver firmly urges top 315 and/or lip 335 into lower cavity 120 such that it becomes fully received with a fluid tight seal with fitting 105. The care giver then rotates shield 110 relative to fitting 105 to assume the open position and permit fluid flow. Finally, the care giver pulls infant care apparatus 100 relative to bottle 200 sufficiently to open valved cap assembly 300. An infant then may enjoy fluid from bottle 200 flowing through valved cap assembly 300 and infant care apparatus 100.

When bottle 200 is empty or the infant no longer desires fluid from bottle 200, infant care apparatus 100 may be disconnected from valved cap assembly 300 and used as a pacifier. The care giver firmly urges top 315 and/or lip 335 from lower cavity 120 such that it disengages from fitting 105. The care giver then presses top 315 into base 310 of valved cap assembly 300 to define a closed position for storage and to prevent leakage of the contents of bottle 200. The care giver then rotates shield 110 relative to fitting 105 to assume the closed position to prevent fluid, notably air, from being drawn through infant care apparatus 100 and ingested.

Figure 4:
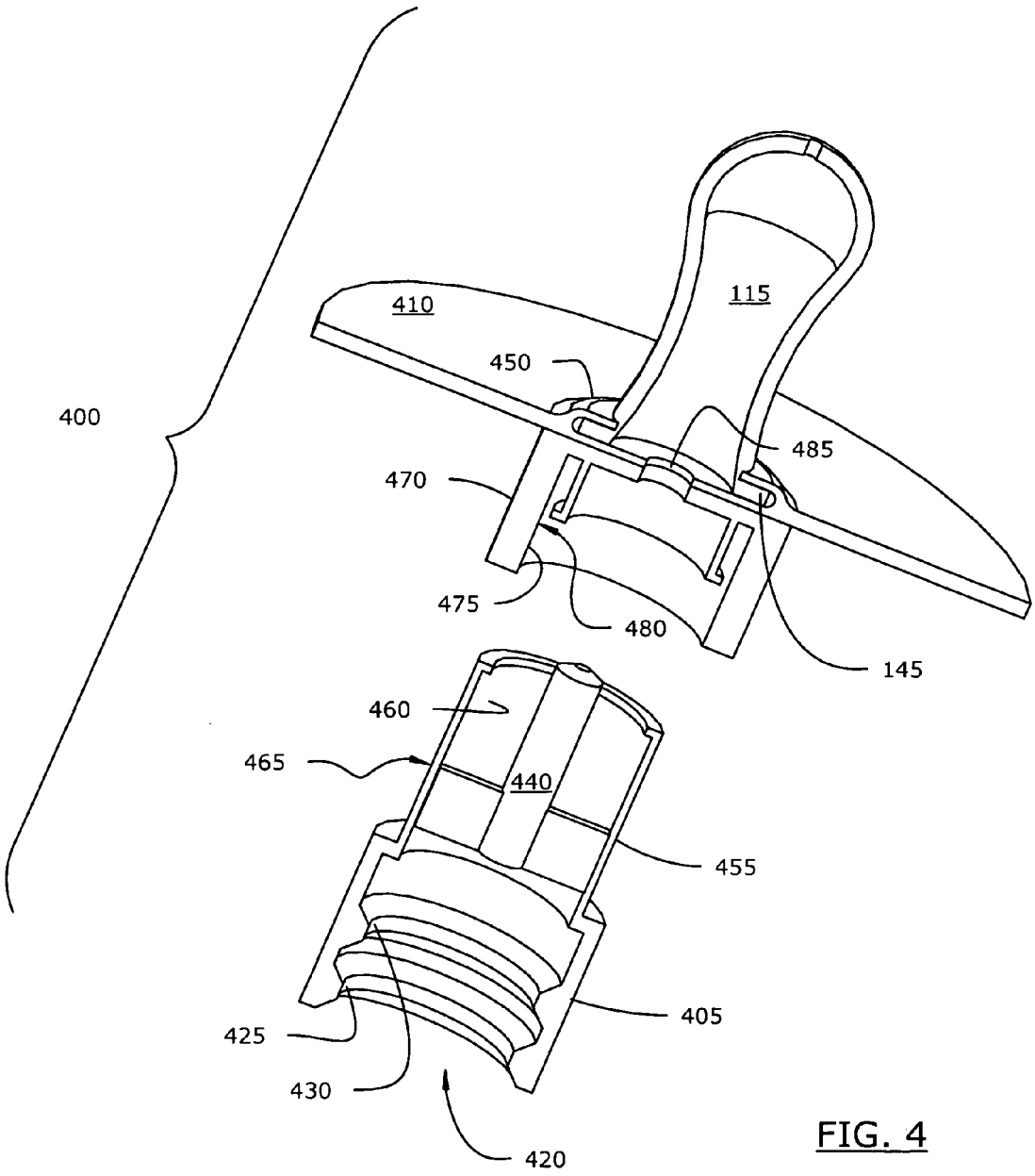
FIG. 4 is a cross-sectional detail view of another embodiment of an infant care apparatus constructed according to principles of the invention.

Referring to FIG. 4, another embodiment constructed according to principles of the invention includes an infant care apparatus 400, which also may be used in conjunction with a bottle (not shown) having a valved cap assembly (not shown). Infant care apparatus 400 includes a fitting 405, a shield 410 and nipple 115.

Fitting 405 preferably is constructed similarly to fitting 105. Like fitting 105, fitting 405 is removably connectable to valved cap assembly 300. Fitting 405 defines a lower cavity 420 configured to receive top 315 and lip 335, and frictionally engage and maintain a fluid seal therewith when fully received. Fitting 405 may have radially inwardly extending bulges 425 and 430 for providing an interference fit with top 315 and/or lip 335. Preferably, fitting 405 is configured so that, when mounted on top 315, exerting requisite force on fitting 405 opens or closes valved cap assembly 300. Different types of mounting conventions between fitting 405 and valved cap assembly 300 also may be employed including, but not limited to, snap on/snap off, twist on/twist off, and partial-turn bayonet. However, the invention may employ any mounting and/or sealing convention suitable for the purposes described herein.

Shield 410 preferably is configured to prevent ingestion of infant care apparatus 400. Shield 410 has a boss 450 for sealingly retaining flange 145 of nipple 115. Shield 410 is connected to fitting 405 similar to how top 315 and spout 310 of valved cap assembly 300 are connected for regulating flow through infant care apparatus 400.

Fitting 405 has an inner sleeve 455 extending therefrom. Inner sleeve 455 defines a passage 460 for voiding fluid (not shown) from bottle (not shown). Inner sleeve 455 is constructed from materials and defines an outer surface 465 that allow outer sleeve 470 of shield 410 to slide relative to inner sleeve 455 while maintaining a fluid seal therewith.

Outer sleeve 470 defines a passage 475 for receiving inner sleeve 455. Outer sleeve 470 is constructed from materials and defines an inner surface 480 that allow outer sleeve 470 to slide relative to inner sleeve 455 while maintaining a fluid seal therewith. Shield 410 has a centrally disposed aperture 485 for selectively providing in fluid communication with passage 475.

A stopper 440 is disposed in passage 460 for regulating fluid flow. When outer sleeve 470 assumes a closed position relative to inner sleeve 455, stopper 440 plugs aperture 485 preventing fluid flow. When outer sleeve 470 is pulled relative to inner sleeve 455 to assume an open position, stopper 440 is withdrawn from aperture 485 permitting fluid flow.

In operation, to provide an infant fluid from a bottle 200 having a valved cap assembly 300 via infant care apparatus 400, a care giver firmly urges top 315 and/or lip 335 into lower cavity 420 such that it becomes fully received with a fluid tight seal with fitting 405. The care giver then pulls outer sleeve 470 relative to inner sleeve 455 to assume an open position and withdraw stopper 440 from aperture 485. Finally, the care giver pulls infant care apparatus 400 relative to bottle 200 sufficiently to open valved cap assembly 300. An infant then may enjoy fluid from bottle 200 flowing through valved cap assembly 300 and infant care apparatus 400.

When bottle 200 is empty or the infant no longer desires fluid from bottle 200, infant care apparatus 400 may be disconnected from valved cap assembly 300 and used as a pacifier. The care giver firmly urges top 315 and/or lip 335 from lower cavity 420 such that it disengages from fitting 405. The care giver then presses top 315 into base 310 of valved cap assembly 300 to define a closed position for storage and to prevent leakage of the contents of bottle 200. The care giver then pushes outer sleeve 470 into inner sleeve 455 to assume the closed position so that stopper 440 plugs aperture 485 and prevents fluid flow, notably air, from being drawn through infant care apparatus 400 and ingested.

Figure 5:
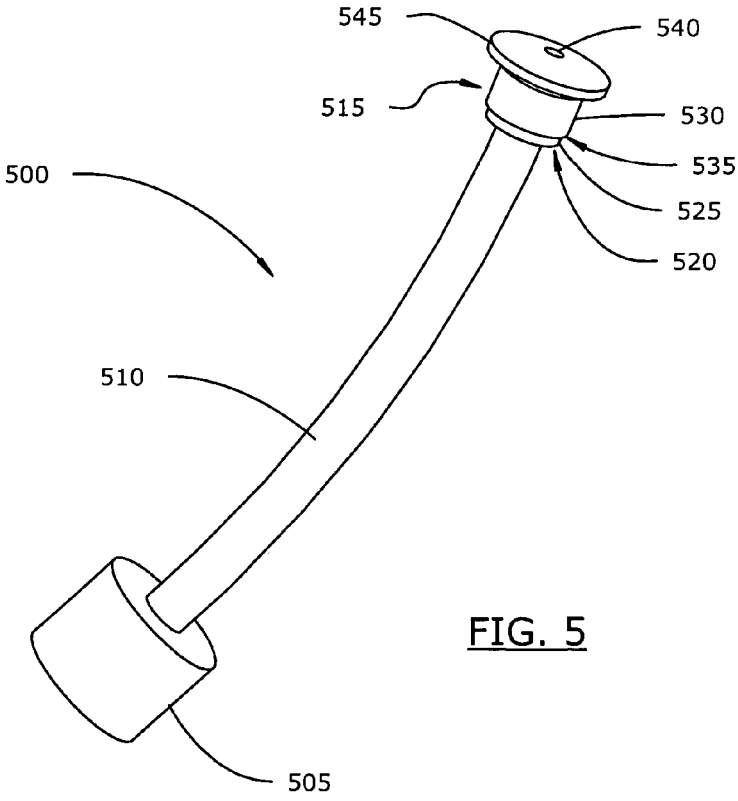
FIG. 5 is a side elevational view of an extension constructed according to principles of the invention.

Referring to FIG. 5, another embodiment constructed according to principles of the invention includes an extension 500 for providing fluid communication between valved cap assembly 300 and infant care apparatus 100 or 400. Extension 500 includes a fitting 505, a conduit 510 and a valve 515.

Fitting 505 is similar to fitting 105, described above.

Conduit 510 is constructed of a rubber or silicon or similar soft, elastic, resilient, plastic material. Conduit 510 provides fluid communication between fitting 505 and valve 515.

Valve 515 operates like valved cap assembly 300. Valve 515 includes a base 520, a spout 525 and a top 530. Base 520 connects with conduit 510 and provides for fluid communication between conduit 510 and top 530.

Spout 525 extends from, and may be integral with, base 520. Spout 525 defines a passage (not shown) for voiding fluid (not shown) from conduit 510. Spout 525 is constructed from materials and defines an outer surface 535 that allow top 530 to slide relative to spout 525 while maintaining a fluid seal therewith.

Top 530 defines a passage (not shown) for receiving spout 525. Top 530 is constructed from materials and defines an inner surface (not shown) that allow top 530 to slide relative to spout 525 while maintaining a fluid seal therewith. Top 530 has a centrally disposed aperture 540 for selectively providing in fluid communication with conduit 510. Top 530 also has a lip 545 to facilitate moving top 530 relative to base 520.

A stopper (not shown) is disposed in spout 525 for regulating fluid flow. When top 530 assumes a closed position relative to spout 525, as shown, the stopper plugs aperture 540 preventing fluid flow. When top 530 is pulled relative to base 520 to assume an open position (not shown), the stopper is withdrawn from aperture 540 permitting fluid flow.

Valve 515 may have a cover (not shown) to prevent contamination of portions of valve 515 received orally or otherwise delivering fluid for consumption.

Figure 6:
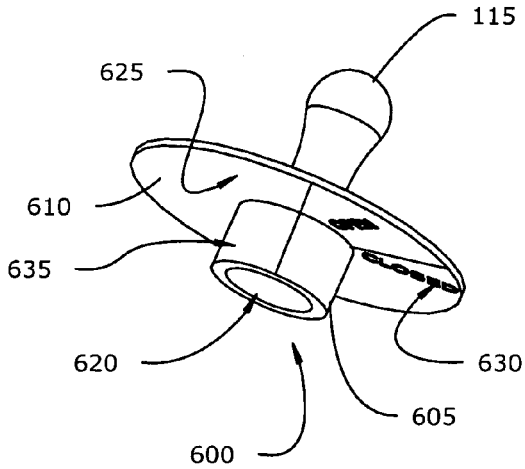
FIG. 6 is bottom side elevational view of another embodiment of an infant care apparatus constructed according to principles of the invention.

Referring to FIG. 6, another embodiment constructed according to principles of the invention includes an infant care apparatus 600. Infant care apparatus 600 includes a fitting 605, a shield 610 and nipple 115.

Fitting 605 is constructed similarly to fitting 105. Fitting 605 is removably connectable to valved cap assembly 300. Fitting 605 defines a lower cavity 620 configured to receive top 315 and lip 335, and frictionally engage and maintain a fluid seal therewith when fully received, similar to fitting 105.

Shield 610 preferably is configured to prevent ingestion of infant care apparatus 600. Shield 610 has a boss (not shown) for sealingly retaining flange 145 of nipple 115. Shield 610 is rotatingly connected to fitting 605 similar to shield 110 and fitting 105 of infant care apparatus 100.

Fitting 605 has indicia 635 calibrated to a position related to throughbores (not shown) for providing fluid passage through fitting 605. Shield 610 has indicia 625, which, when aligned with indicia 635, correspond to when shield 610 and fitting 605 define an opened position, when infant care apparatus 600 promotes fluid communication. Shield 610 has indicia 630, which, when aligned with indicia 635, correspond to when shield 610 and fitting 605 define a closed position, when infant care apparatus 600 prevents fluid communication.

Another embodiment constructed according to principles of the invention includes a stem/stem screen pickup tube for providing fluid communication between a valved cap assembly and a remote volume of a bottle. Stem screen pickup tube has a screen for straining unwanted particles from entry.

Other embodiments constructed according to principles of the invention employ bottles having different shapes, such as rectangular, anti-roll, square, round and combinations thereof, and having different sizes and colors.

Other embodiments constructed according to principles of the invention provide nipples of different materials, sizes, shapes and passages providing diverse flow rates depending on age group or other differentiation. The nipples also may come in diverse colors for ready identification, a feature that may be useful where multiple infants, some less healthy than others, are bottle feeding in a communal area.

The invention is not limited to particular embodiments described herein, rather only to the following claims.

I claim:

1. Infant care apparatus comprising:

a nipple having a nipple passage;

a fitting adapted to secure said infant care apparatus on a closure adapted to regulate flow between said infant care apparatus and a container; and a valve adapted to regulate flow between said nipple passage and the closure;

said valve comprising a plate having a passage for providing fluid communication with said nipple passage, rotatably connected to said fitting;

wherein, when said infant care apparatus is secured on the closure, said valve and/or the closure are independently actuable;

wherein said fitting has fitting passage and registry of said plate passage and said fitting passage permits fluid flow while non-registry thereof blocks fluid flow;

first indicia on said fitting; and second indicia on said plate;

wherein a first alignment of said first indicia and said second indicia corresponds to registry of said plate passage and said fitting passage and a second alignment of said first indicia and said second indicia corresponds to non-registry of said plate passage and said fitting passage.

2. Infant care apparatus of claim 1, wherein said fitting is adapted to provide interfering, threading or bayoneting engagement with the closure.

3. Infant care apparatus of claim 1, wherein said valve has elements that are rotatable or slidable between and including a closed position, prohibiting flow, and an open position, permitting flow.

4. Infant care apparatus of claim 1, further comprising:

a first sleeve having a first sleeve passage for providing fluid communication with said nipple passage;

a second sleeve, having a second sleeve passage for providing fluid communication with the closure, slidingly received by said first sleeve; and a stopper operably connected to said second sleeve;

wherein when said first sleeve and said second sleeve define a closed position, said stopper prevents flow between said nipple passage and said first sleeve passage and when said first sleeve and said second sleeve define an opened position, said stopper does not prevent flow between said nipple passage and said first sleeve passage.

5. Infant care apparatus comprising:

a closure adapted to regulate flow between said infant care apparatus and a container;

a fitting secured on said closure;

a nipple having a nipple passage for drawing fluid therethrough;

a valve adapted to regulate flow between said nipple passage and said closure;

a plate, having a plate passage for providing fluid communication with said nipple passage, rotatably connected to said fitting;

wherein said fitting has a fitting passage;

wherein registry of said plate passage and said fitting passage permits fluid flow said valve and/or said closure are independently actuable;

first indicia on said fitting; and second indicia on said plate;

wherein a first alignment of said first indicia and said second indicia corresponds to registry of said plate passage and said fitting passage and a second alignment of said first indicia and said second indicia corresponds to non-registry of said plate passage and said fitting passage.

6. Infant care apparatus of claim 5, further comprising:

a first sleeve having a first sleeve passage for providing fluid communication with said nipple passage;

a second sleeve, having a second sleeve passage for providing fluid communication with the closure, slidingly received by said first sleeve; and a stopper operably connected to said second sleeve;

wherein when said first sleeve and said second sleeve define a closed position, said stopper prevents flow between said nipple passage and said first sleeve passage and when said first sleeve and said second sleeve define an opened position, said stopper does not prevent flow between said nipple passage and said first sleeve passage.

7. Infant care apparatus of claim 5, wherein said closure has elements that are slidable between and including a closed position, prohibiting flow therethrough, and an open position, permitting flow therethrough.

8. Infant care apparatus comprising:

a closure adapted to regulate flow between said infant care apparatus and a container;

a fitting secured on said closure;

a nipple having a nipple passage for drawing fluid therethrough;

a valve adapted to regulate flow between said nipple passage and said closure;

wherein, when said infant care apparatus is secured on the closure, said valve and/or the closure are independently actuable;

an extension adapted to conduct fluid said closure, wherein said extension comprises:

an extension fining adapted to secure said extension on the closure;

an extension closure adapted to regulate flow trough said extension; and a conduit adapted to provide fluid communication between said extension fitting and said extension closure.

9. Infant care apparatus of claim 8, wherein said extension fitting is adapted to provide interfering, threading or bayoneting engagement with the closure.

10. Infant care apparatus of claim 8, wherein said extension closure comprises:

a first extension sleeve having a first extension sleeve passage;

a second extension sleeve, having a second extension sleeve passage, slidingly received by said first extension sleeve; and an extension stopper operably connected to said second extension sleeve;

wherein when said first extension sleeve and said second extension sleeve define a closed position, said extension stopper prevents flow and when said first extension sleeve and said second extension sleeve define an opened position, said extension stopper does not prevent flow.

11. Infant care apparatus comprising a container;

a closure adapted to regulate flow to and from said container;

a fitting secured on said closure;

a nipple having a nipple passage for drawing fluid therethrough; and a valve adapted to regulate flaw between said nipple passage and said closure;

wherein, when said infant care apparatus is secured on said closure, said valve and/or said closure are independently actuable;

a plate, having a plate passage for providing fluid communication with said nipple passage, rotatably connected to said fitting;

wherein said fitting has a fitting passage;

wherein registry of said plate passage and said fitting passage permits fluid flow and non-registry thereof blocks fluid flow;

first indicia on said fitting; and second indicia on said plate;

wherein a first alignment of said first indicia and said second indicia corresponds to registry of said plate passage and said fitting passage and a second alignment of said first indicia and said second indicia corresponds to non-registry of said plate passage and said fitting passage.

12. Infant care apparatus of claim 11, wherein said fitting is adapted to provide interfering, threading or bayoneting engagement with the closure.

13. Infant care apparatus of claim 11, wherein said valve has elements that are rotatable or slidable between and including a closed position, prohibiting flow, and an open position, permitting flow.

14. Infant care apparatus of claim 11, further comprising:

a first sleeve having a first sleeve passage for providing fluid communication with said nipple passage;

a second sleeve, having a second sleeve passage for providing fluid communication with the closure, slidingly received by said first sleeve; and a stopper operably connected to said second sleeve;

wherein when said first sleeve and said second sleeve define a closed position, said stopper prevents flow between said nipple passage and said first sleeve passage and when said first sleeve and said second sleeve define an opened position, said stopper does not prevent flow between said nipple passage and said first sleeve passage.

15. Infant care apparatus of claim 11, wherein said closure has elements that are slidable between and including a closed position, prohibiting flow therethrough, and an open position, permitting flow therethrough.

16. Infant care apparatus comprising:

a container;

a closure adapted to regulate flow to and from said container;

a fitting on said closure;

a nipple having a nipple passage for drawing fluid therethrough;

a valve adapted to regulate flow between said nipple passage and said closure;

wherein, when said infant care apparatus is secured on the closure, said valve and the closure are independently actuable; and an extension adapted to conduct fluid to and from said closure;

wherein said extension comprises:

an extension fitting adapted to secure said extension on the closure;

an extension closure adapted to regulate flow through said extension; and a conduit adapted to provide fluid communication between said extension fitting and said extension closure.

17. Infant care apparatus of claim 16, wherein said extension fitting is adapted to provide interfering, threading or bayoneting engagement with the closure.

18. Infant care apparatus of claim 16, wherein said extension closure comprises:

a first extension sleeve having a first extension sleeve passage;

a second extension sleeve, having a second extension sleeve passage, slidingly received by said first extension sleeve; and an extension stopper operably connected to said second extension sleeve;

wherein when said first extension sleeve and said second extension sleeve define a closed position, said extension stopper prevents flow and when said first extension sleeve and said second extension sleeve define an opened position, said extension stopper does not prevent flow.

* * * * *